United States Patent [19]

Fischer et al.

[11] Patent Number: 4,743,515

[45] Date of Patent: May 10, 1988

[54] CEMENTED CARBIDE BODY USED PREFERABLY FOR ROCK DRILLING AND MINERAL CUTTING

[75] Inventors: Udo K. R. Fischer, Vällingby; Erik T. Hartzell, Älvsjö ; Jan G. H. Åkerman, Hägersten, all of Sweden

[73] Assignee: Santrade Limited, Lucerne, Switzerland

[21] Appl. No.: 791,556

[22] Filed: Oct. 25, 1985

[30] Foreign Application Priority Data

Nov. 13, 1984 [SE] Sweden ..... 8405667
Aug. 14, 1985 [SE] Sweden ..... 8503804

[51] Int. Cl.[4] ..... B32B 15/04

[52] U.S. Cl. ..... 428/698; 428/699; 428/336; 428/472

[58] Field of Search ..... 428/698, 699, 432, 336

[56] References Cited

U.S. PATENT DOCUMENTS

| | | | |
|---|---|---|---|
| 2,285,900 | 6/1942 | Dawihi | 75/136 |
| 3,329,487 | 7/1967 | Sowko et al. | 75/182.7 |
| 3,999,953 | 12/1976 | Kolaska et al. | 75/182.7 |
| 4,035,541 | 7/1977 | Smith et al. | 428/409 X |
| 4,049,876 | 9/1977 | Yamamoto et al. | 428/698 X |
| 4,066,451 | 1/1978 | Rudy | 75/240 |
| 4,097,275 | 6/1978 | Horvath | 75/203 |
| 4,150,195 | 4/1979 | Tobioka et al. | 428/548 |
| 4,225,344 | 9/1980 | Fujimori et al. | 75/203 |
| 4,265,662 | 5/1981 | Miyake et al | 75/230 |
| 4,368,788 | 1/1983 | Drake | 175/374 |

*Primary Examiner*—Nancy Swisher
*Attorney, Agent, or Firm*—Burns, Doane, Swecker & Mathis

[57] ABSTRACT

The present invention relates to cemented carbide bodies preferably for rock drilling and mineral cutting. By having the bodies comprising a core of cemented carbide containing eta-phase surrounded by a surface zone of cemented carbide free of eta-phase and having a low content of cobalt in the surface and a higher content of cobalt next to the eta-phase zone the bodies have obtained an increased strength and life in practical use.

18 Claims, 2 Drawing Sheets

CEMENTED CARBIDE BODY USED PREFERABLY FOR ROCK DRILLING AND MINERAL CUTTING

The present invention relates to cemented carbide bodies preferably used in tools for drilling of rock and mineral. Tools for cutting of asphalt and concrete are also included.

Up to now, it has been generally accepted, that cemented carbide for the above mentioned applications shall have a two-phase composition i.e. consist of uniformly distributed WC (alpha-phase) and cobalt (beta-phase). Presence of free carbon or intermediate phases such as $M_6$-carbide, $W_3Co_3C$ (eta-phase)—because of high or low contents of carbon, respectively,—has been considered as harmful for said products by the experts.

Practical experience has confirmed the above-mentioned opinion, in particular concerning low-carbon phases such as eta-phase, where said phase has been distributed in the entire cemented carbide body or located to the surface. The reason for said negative results is the more brittle behaviour of the eta-phase, i.e. microcracks, starting in the surface, are often initiated in the eta-phase and the cemented carbide body will easily break.

In percussive rock drilling there are two types of tools, such as tools with brazed inserts and tools with pressed in buttons. A desire is to increase the wear resistance of the cemented carbide which is normally obtained by decreasing the content of cobalt. Cemented carbide with a low content of cobalt means, however, that rock drilling inserts can not be brazed because of risks for breakage in consequence of brazing stresses. Nowadays, button bits are used to a great extent, at which a low content of cobalt can be used. At the fitting of the buttons a gap is often formed in the top part of the contact surface between button and steel in the bit because of the hole drilling. Said gap grows when the bit is used and it leads eventually to fracture, which can happen relatively close to the bottom face of the button.

It has now been surprisingly found, however, that a remarkable improvement of the strength can be obtained if the cemented carbide bodies are made under such conditions that a region with finely and uniformly distributed eta-phase—embedded in the normal alpha+beta-phase structure—is created in the centre of said bodies. At the same time, there shall be a surrounding surface zone with only alpha+beta-phase. With etaphase we mean low-carbon phases of the W-C-Co-system such as the $M_6C$- and $M_{12}C$-carbides and kappa-phase with the approximate formula $M_4C$.

It is necessary that the surface zone is completely free of eta-phase in order to maintain the excellent fracture strength properties of the WC-Co cemented carbide. The zone free of eta-phase can for example be made by addition of carbon at high temperature to cemented carbide bodies having eta-phase throughout. By varying time and temperature, a zone free of eta-phase with desired thickness can be obtained.

The greater strength of the body can be explained as follows. The eta-phase core has greater stiffness than the WC-Co cemented carbide which means that the body is exposed to smaller elastic deformation leading to smaller tensile stresses in the critical surface zone when the body is loaded when drilling. The consequence is that the invention is particularly suited for bodies such as buttons where the ratio between the height and the maximum width is greater than 0.75, preferably greater than 1.25.

The content of binder phase be small in the outer part of the zone free of eta-phase, i.e. lower than nominal content of binder phase. It has also been found that the content of binder phase i.e. the content of cobalt, shall be considerably higher, i.e. higher than the nominal one, in the inner part of the zone free of eta-phase. The cobalt-rich zone leads to compressive stresses in the surface zone and has also positive effects on strength and toughness. The result is a tool having greater wear resistance and which stands higher loads and which can also be brazed.

As the drilling proceeds, the buttons obtain an increasing wear flat, which in its turn will give rise to an increased mechanical stress. The contact surface between cemented carbide and rock increases, the forces become soon very high upon the buttons and the risk of breaking increases. Buttons with an eta-phase core according to the invention can have considerably greater wear flats compared to conventional buttons because of the substantially increased rigidity and strength. (The reason for regrinding conventional buttons is among other things to remove the wear flat in order to decrease the stress, i.e. the risk of fracture. Regrinding could thus be avoided to an increased extent by using buttons according to the invention.)

Cemented carbide containing eta-phase has generally a higher hardness than corresponding material with the same composition but being free of eta-phase. As will be evident from the following examples, the performance increasing effect of the eta-phase core cannot be explained by the higher hardness, i.e. an increased wear resistance. The WC-Co-variant having a hardness corresponding to the eta-phase-variant has in all the examples shown inferior performance.

The eta-phase shall be fine grained with a grain size of 0.5–10 μm preferably 1–5 μm, and uniformly distributed in the matrix of the normal WC-Co structure in the centre of the cemented carbide body. It has been found that the thickness of the eta-phase core shall be 10–95%, preferably 30–65% of the width of the cemented carbide body to make good results obtainable.

The core should contain at least 2% by volume, preferably at least 10% by volume of eta phase because no effect will be obtained otherwise, but at the most 60% by volume, preferably at the most 35% by volume.

In the zone free of eta-phase the content of binder phase, i.e. in general the content of cobalt, shall in the surface be 0.1–0.9, preferably 0.2–0.7 of the nominal content of binder phase. It shall gradually increase up to at least 1.2, preferably 1.4–2.5 of the nominal content of binder phase at the boundary close to the eta-phase core. The width of the zone poor of binder phase shall be 0.2–0.8, preferably 0.3–0.7 of the width of the zone free of eta-phase, but at least 0.4 mm and preferably at least 0.8 mm in width.

The positive increase of the performance is noticed at all cemented carbide grades being normally used in the above-mentioned applications, from grades having 3% by weight of cobalt up to grades with 35% by weight of cobalt, preferably 5–10% by weight of cobalt for percussive rock drilling, 6–25% by weight of cobalt for rotary-crushing rock drilling and 6–13% of cobalt for mineral tools. The grain size of WC can vary from 1.5 μm up to 8 μm, preferably 2–5 μm.

Figure 1:
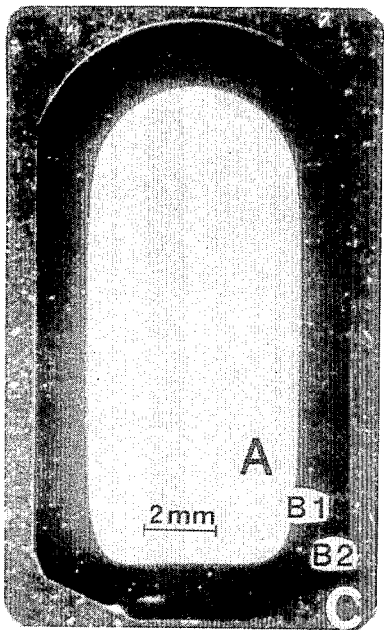
FIG. 1 shows a button according to the invention in longitudinal. In the figure, A indicates cemented carbide containing eta-phase, B1 indicates cemented carbide free of eta-phase and having a high content of cobalt, B2 indicates cemented carbide free of eta-phase and having a low content of cobalt and C indicates embedment mass (bakelite).
Figure 3:
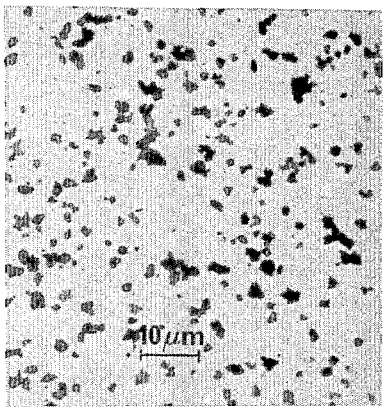
FIG. 3 is a photomicrograph of the structure of the button of FIG. 1 at A.
Figure 4:
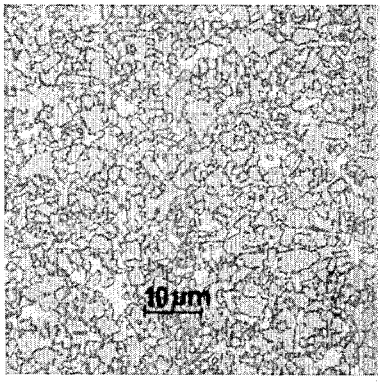
FIG. 4 is a photomicrograph of the structure of the button of FIG. 1 at B1.
Figure 6:
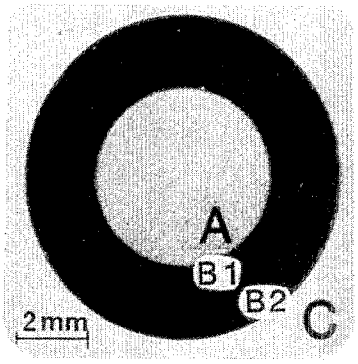
FIG. 6 is a cross sectional view of the button according to the invention.
Figure 5:
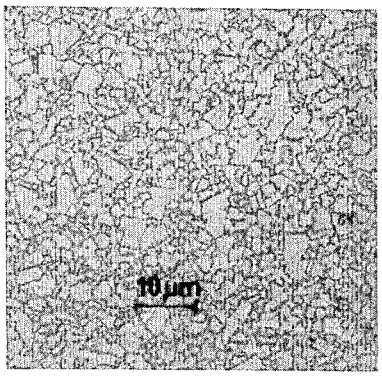
FIG. 5 is a photomicrograph of the structure of the button of FIG. 1 at B2.
Figure 2:
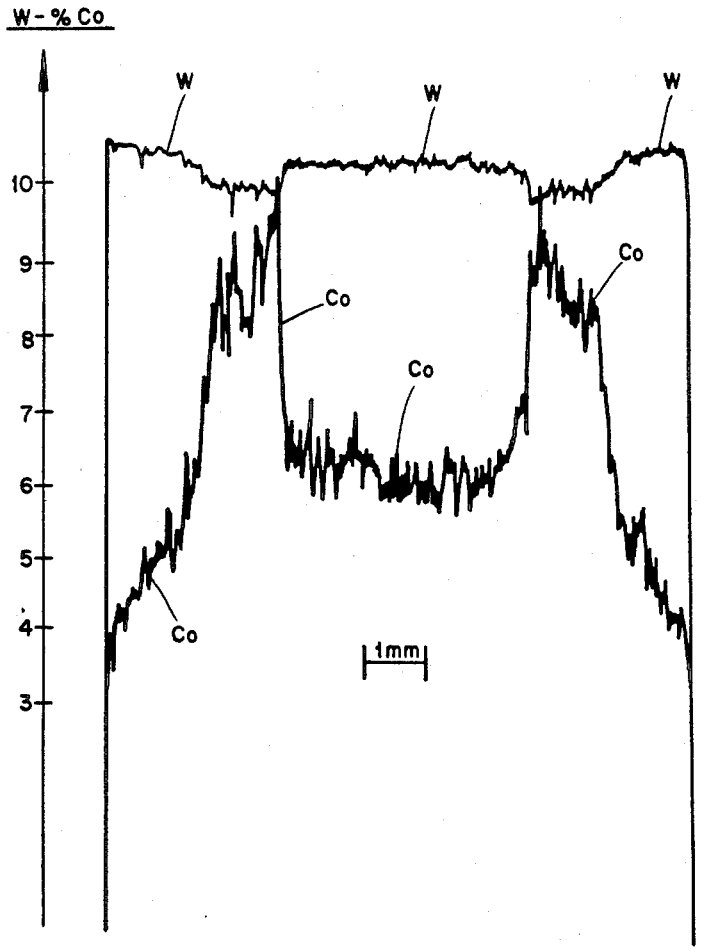
FIG. 2 shows the distribution of cobalt and tungsten along a diameter of the button in FIG. 1.

It has also been found that the amount of cobalt in the eta-phase can be wholly or partly replaced by any of the metals iron or nickel, i.e. the very eta-phase can consist of one or more of the iron group metals in combination. Also in this case the performance of the cemented carbide is increased to a surprisingly great extent.

In the text above as well as in the examples below, the positive effects of the eta-phase in the centre of cemented carbide buttons are shown only in those cases where the alpha phase is WC and the beta phase is based upon one or more of the iron group metals (iron, nickel or cobalt). Preliminary experiments have, however, given very promising results, also when at the most 15% by weight of tungsten in the alpha phase is substituted by one or more of the metallic carbide formers Ti, Zr, Hf, V, Nb, Ta, Cr and Mo.

The text has only dealt with cemented carbide buttons for percussive rock drilling but it is evident that the invention can be applied to various kinds of cemented carbide bodies such as rock drilling inserts, wear parts or other parts exposed to wear.

EXAMPLE 1

From a WC-6% cobalt powder with 0.3% substoichiometric carbon content (5.5% C instead of 5.8% C for conventional cemented carbide) buttons were pressed having a height of 16 mm and a diameter of 10 mm. The buttons were pre-sintered in $N_2$ gas for 1 h at 900° C. and standard sintered at 1450° C. After that the buttons were sparsely packed in fine $Al_2O_3$ powder in graphite boxes and thermally treated in a carburizing atmosphere for 2 h at 1450° C. in a pusher type furnace. At the initial stage of the sintering there was formed a structure of alpha+beta-phase and uniformly distributed, fine-grained eta-phase therein. At the same time there was formed in the surface of the buttons a very narrow zone of merely alpha+beta structure because carbon begins to diffuse into the buttons and transform the eta-phase to alpha+beta-phase. After 2 hours' sintering time a sufficient amount of carbon had diffused and transformed all the eta-phase in a wide surface zone. The buttons made in this way had after the sintering a 2 mm surface zone free of eta-phase and a core with the diameter 6 mm containing finely distributed eta-phase. The content of cobalt at the surface was 4.8% and immediately outside the eta phase 10.1%. The width of the part having a low content of cobalt was about 1 mm.

EXAMPLE 2

Rock: Hard abrasive granite with small amounts of leptite, compressive strength 2800–3100 bar.

Machine: Atlas Copco COP 1038 HD. Hydraulic drilling machine for heavy drifter equipment. Feeding pressure 85 bar, rotating pressure 45 bar, number of revolutions 200 rpm.

Bits: 45 mm button bits. 2 wings with 10 mm peripheral buttons with height 16 mm, 10 bits per variant.

Cemented carbide composition: 94% by weight of WC and 6% by weight of cobalt. Grain size (variant 1–3)=2.5 μm.

Test variants:

Eta-phase variants 1. eta-phase core ϕ6 mm, surface zone free of eta-phase 2 mm and having a gradient of cobalt.
2. eta-phase core ϕ7.5 mm, surface zone free of eta-phase 1.25 mm having a gradient of cobalt.

Conventional grades

3. WC-Co structure without eta-phase.
4. WC-Co structure without eta-phase but more fine-grained about 1.8 μm.

Procedure:

The bits were drilled in sets of seven holes at 5 meters and shifted to give just drilling conditions. The bits were immediately taken out from testing at the first damage on the buttons and the number of drilled meters were noted.

| | Number of drilled meters | | | |
|---|---|---|---|---|
| Variant | mean | max | min | scatter |
| 1 | 300.8 | 359 | 270 | 32.9 |
| 2 | 310.2 | 361 | 271 | 39.8 |
| 3 | 225.8 | 240 | 195 | 17.2 |
| 4 | 220 | 340 | 103 | 65 |

The best eta-phase variant showed about 40% longer life than the best conventional grade.

EXAMPLE 3

Rock: Abrasive granite with compressive strength about 2000 bar.

Machine: Atlas Copco Cop 62, pneumatic caterpillar drive equipment for down-hole rock drilling. Air pressure 18 bar, number of revolutions 40 rpm.

Bits: 165 mm down-the-hole bits with buttons ϕ14, height 24 mm, 5 bits/variant. Interval of regrinding: 42 m. Hole depth: 21 m.

Cemented carbide composition according to Example 2. All variants had a grain size of 2.5 μm.

Test variants:

Eta-phase variant 1. 7 mm eta-phase core and 3.5 mm surface zone free of eta-phase. The content of cobalt in the surface was 3.5% and 10.5% in the part rich in cobalt. The width of the part having a low content of cobalt was 1.5 mm.

Conventional reference grades

2. WC-Co without eta-phase.
3. WC-Co without eta-phase, fine-grained, 1.8 μm.

Procedure:

At each regrinding, i.e. after every second hole, the order of the bits was reversed so that equal drilling conditions were secured. The drilling was stopped for each bit when the diameter wear became too great or when some button damage could be noted.

Result:

| Varient | Drilled meters mean | Drilled meters index | Hardness before drilling surface zone | Hardness before drilling 3 mm from the surface | Hardness before drilling (centre) |
|---|---|---|---|---|---|
| 1 | 820 | 100 | 1560 | 1390 | 1520 |
| 2 | 573 | 70 | 1420 | 1420 | 1415 |
| 3 | 429 | 52 | 1520 | 1520 | 1515 |

EXAMPLE 4

500 $m^2$ asphalt of medium to strongly abrasive type was milled without heating. Air temperature 15° C. Three variants were tested.

Machine: Arrow CP 2000 road planing machine. Hydraulic, four wheel driven machine with automatic cutting depth control.

Cutting drum: Width 2 m, diameter incl. tool: 950 mm, peripheral speed: 3.8 m/s, cutting depth: 40 mm.

Equipment: 166 tools uniformly placed around the drum, of which 60 tools (20 per variant) had conventional cemented carbide, (1) and (2), and cemented carbide according to the invention (3). The test variants were working in pairs at the same time and were equally distributed around the drum along the whole width.

Test variants

| | Cobalt w/o | Number of tools | Remarks |
|---|---|---|---|
| 1. Conventional grade | 9.5 | 106 | normal |
| 2. Conventional grade | 8 | 20 | lower cobalt-content to obtain increased wear resistance and hardness. |
| 3. Eta-phase variant | 9.5 | 20 | about 1.5 mm surface zone free of eta-phase with gradient of cobalt. |

All buttons had the height 17 mm and diameter 16 mm.

As soon as a test button or a normal button failed, the tool was immediately replaced by a standard tool.

Result

| Variant | Height reduction (wear), mm | Damaged and replaced buttons | Rank |
|---|---|---|---|
| 1 | 3.5 | 1.2 (relative) | III |
| 2 | 2.6 | 2 | II |
| 3 | 2.6 | 0 | I |

EXAMPLE 5

Testing place: Drilling in open pit mine with roller bits (three cone bits).

Machine: Bycyrus Erie 60 R. Feeding force 40 tons at 70 rpm. Holes with depths between 10 and 17 m were drilled.

Drilling bit: 12¼" roller bits, two bits per variant.

Rock: Mainly gangue with zones of quartz, compressive strength 1350–1600 kp/$cm^2$.

Test variants:

1. Standard 10% cobalt, button $\phi$14 mm and height 21 mm.
2. Eta-phase variant 10% cobalt, button $\phi$14 mm and height 21 mm having 2 mm surface zone free of eta-phase and $\phi$9 mm eta-phase-core. Gradient of cobalt 7% in the surface and 15% in the cobalt rich part. The width of the cobalt poor part being 1.5 mm.

Results

| Variant | Drilled meters | index | drilling depth, m/h | index |
|---|---|---|---|---|
| 1 | 1220 | 100 | 13 | 100 |
| 2 | 1750 | 140 | 16 | 123 |

In this example, the variant according to the invention has obtained longer life as well as greater drilling rate.

EXAMPLE 6

In raise boring units rollers with cemented carbide buttons are used. Buttons with eta-phase core were tested in a 7 feet drilling head.

Nature of rock: Gneiss, compressive strength: 262 MPa, hard and wearing.

Drilling unit: Robbins 71 R

Drilled length: 149.5 m

Drilling speed: 0.8 m/h

One roller was equipped with buttons $\phi$22 mm and height 30 mm in a standard grade with 15% cobalt and remainder 2 $\mu$m WC. A testing roller placed diametrically on the raise boring head was equipped with buttons having eta-phase core according to the following:

15% cobalt, 2 $\mu$m WC

Surface zone free of eta-phase: 3 mm

Width of eta-phase core: 16 mm

Results: In the roller with standard buttons 30% of the buttons had got damages, while in the test roller only 5% of the buttons were out of use.

EXAMPLE 7

Test with $\phi$48 mm insert bits

Rock: Magnetite+gangue.

Drilling machine: Atlas Copco COP 1038HD.

Drifter drilling

Cutting insert: Height 21 mm, width 13 mm length 17 mm.

Cemented carbide grade: 11% cobalt, 4 $\mu$m WC.

Variant 1

Surface zone free of eta-phase: 3 mm cobalt-content in the surface: 8%.

Variant 2

Standard

Result

| | Life, drilled meters | Diameter wear resistance, m/mm |
|---|---|---|
| Variant 1 | 508 | 416 |
| Variant 2 | 375 | 295 |

The wear resistant surface zone has given better resistance at the same time as the total life has increased 35%.

We claim:

1. A cemented carbide body preferably for rock drilling and mineral cutting comprising at least two layers comprising a core of cemented carbide and a surface layer of cemented carbide surrounding said core wherein both the surface layer and the core contain WC (alpha-phase) with a binder phase (beta-phase) based upon at least one of cobalt, nickel or iron, and wherein the core layer further contains eta-phase and the surface layer is a diffusion layer free of eta-phase.

2. Cemented carbide body according to claim 1, characterized in that the grain size of the eta-phase is 0.5–10 μm.

3. Cemented carbide body according to claim 1, characterized in that the content of eta-phase in the core is 2–60% by volume.

4. Cemented carbide body according to claim 1 characterized in that the width of the eta-phase containing core is 10–95% of the diameter of the body.

5. Cemented carbide body according to claim 1 characterized in that at the most 15% by weight of tungsten in the alpha-phase is replaced by one or more of the metallic carbide formers Ti, Zr, Hf, V, Nb, Ta, Cr and Mo.

6. Cemented carbide body according to claim 1 characterized in that the content of binder phase in the outer part of the surface layer is lower than the nominal content of the binder phase.

7. Cemented carbide body according to claim 1 characterized in that the width of the outermost part of the surface layer is pocr in binder phase and said part has a width of 0.2–0.8 of the width of the layer free of eta-phase.

8. Cemented carbide body according to claim 1 characterized in that the content of binder phase in the outermost part of the surface layer which is poor in binder phase is 0.1–0.9 of the nominal content of binder phase.

9. Cemented carbide body according to claim 1 characterized in that the inner part of the surface layer which is free of eta-phase and is situated next to the core containing eta-phase has a content of binder-phase greater than the nominal.

10. Cemented carbide body according to claim 1 characterized in that the content of binder phase in the surface layer increases gradually up to at least 1.2 of the nominal content of binder phase at the boundary against the eta-phase containing core.

11. Cemented carbide body according to claim 2, characterized in that the grain size of the eta-phase is 1–5 μm.

12. Cemented carbide body according to claim 3, characterized in that the content of eta-phase in the core is 10–35% by volume.

13. Cemented carbide body according to claim 4, characterized in that the width of the eta-phase core is 40–75% of the diameter of the body.

14. Cemented carbide body according to claim 7, characterized in that the width of the outermost part is 0.3–0.7 of the width of the zone free of eta-phase.

15. Cemented carbide body according to claim 8, characterized in that the content of binder phase in the outermost part is 0.2–0.7 of the nominal content of binder phase.

16. Cemented carbide body according to claim 10, characterized in that the content of binder phase in the surface layer increases gradually up to 1.4–2.5 of the nominal content of binder phase at the boundary against the eta-phase containing core.

17. Cemented carbide body according to claim 1 characterized in that the ratio between the height and maximum width of the cemented carbide body is greater than 0.75.

18. Cemented carbide body according to claim 17 characterized in that the ratio between the height and maximum width of the cemented carbide body is greater than 1.25.

* * * * *